United States Patent [19]

Mills

[11] Patent Number: 4,528,043

[45] Date of Patent: Jul. 9, 1985

[54] SURFACE OXIDE LAYER TREATMENT

[75] Inventor: David Mills, Bristol, England

[73] Assignee: Rolls-Royce Limited, London, England

[21] Appl. No.: 494,528

[22] Filed: May 13, 1983

[30] Foreign Application Priority Data

May 14, 1982 [GB] United Kingdom ..... 8214100

[51] Int. Cl.[3] ..... C23C 9/00

[52] U.S. Cl. ..... 148/13.1; 148/6; 148/31.5; 427/383.9

[58] Field of Search ..... 148/13.1, 31.5, 11.5 F, 148/133, 6.3, 27, 3, 4, 6; 427/383.9; 428/651; 264/344, 345

[56] References Cited

U.S. PATENT DOCUMENTS

| | | | |
|---|---|---|---|
| 3,000,755 | 9/1961 | Hanink et al. | 427/383.9 |
| 3,037,883 | 6/1962 | Wachtell et al. | 148/6 |
| 3,556,744 | 1/1971 | Berkley et al. | 428/651 |
| 3,640,778 | 2/1972 | Winfree et al. | 148/6 |
| 3,903,338 | 9/1975 | Cook et al. | 148/13.1 |
| 3,958,047 | 5/1976 | Baldi | 148/31.5 |
| 4,098,450 | 7/1978 | Keller et al. | 148/4 |

FOREIGN PATENT DOCUMENTS

| | | | |
|---|---|---|---|
| 573091 | 3/1959 | Canada | 428/651 |
| 630874 | 11/1961 | Canada | 148/13.1 |
| 2153218 | 5/1973 | Fed. Rep. of Germany | 148/31.5 |
| 1050409 | 12/1966 | United Kingdom . | |
| 1205478 | 9/1970 | United Kingdom . | |
| 691499 | 10/1979 | U.S.S.R. | 148/133 |

*Primary Examiner*—Peter K. Skiff

*Attorney, Agent, or Firm*—Parkhurst & Oliff

[57] ABSTRACT

In Titanium casting the surface of the casting is usually contaminated with a brittle oxide layer which has to be removed. Physical or chemical machining reduces the dimensions of the casting and adds to its cost. Chemical reagents may remove fine surface detail.

In accordance with the invention the oxygen in the oxide layer is removed by contacting the surface of the casting with an oxide scavenge agent, notably Titanium, for a sufficient time and at a sufficient temperature to allow diffusion of the oxygen from the surface into the scavenge agent.

5 Claims, 3 Drawing Figures

SURFACE OXIDE LAYER TREATMENT

BACKGROUND AND SUMMARY OF THE INVENTION

This invention relates to the treatment of surface oxide layers on articles.

The invention finds particular application to the treatment of articles produced by casting, to treat surface oxide layers which are formed during the casting process.

In the production of articles by casting, surface oxide layers are often formed in the cast article by reaction of the casting material with the casting mould. Such layers are usually brittle and have to be removed to finish the article. It is sometimes possible to inhibit the formation of such layers by coating the interior surfaces of the moulds with an inhibiting material. However, with some casting materials (such as, for example, titanium) this may not be possible or not desirable in view of the increased cost involved, and in these cases the resultant oxide layers must be removed by chemical machining. Unfortunately, chemical machining destroys fine detail in the surface structure of the articles and so can only be used with articles which do not require high dimensional accuracy. For this reason it has been necessary, in order to produce articles of high dimensional accuracy in such materials as titanium, to mechanically machine the articles, thus resulting in high production costs.

It is an object of the present invention to provide a method of treating surface oxide layers on articles whereby the above disadvantages may be overcome or at least alleviated.

In accordance with the present invention a method of treating a surface oxide layer on an article comprises contacting the surface oxide to be treated with an oxygen scavenge agent and heat treating the article in an inert atmosphere for a sufficient time and at a sufficient temperature to cause the oxygen in the surface oxide layer to diffuse into the oxygen scavenge agent.

BRIEF DESCRIPTION OF THE DRAWINGS

One method in accordance with the invention of treating a surface oxide layer on an article will now be described, by way of example only, with reference to the accompanying drawings, in which.

DETAILED DESCRIPTION OF THE PREFERRED EMBODIMENT

Figure 1:
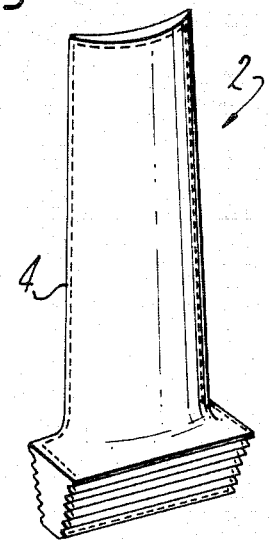
FIGS. 1 to 3 show various steps in the method.

Referring firstly to FIG. 1, a cast titanium rotor blade 2 for use in a gas turbine engine contains, as cast, an integral external surface layer 4 of brittle titanium oxide formed by the reaction of the titanium with the material of the mould (not shown) used in the casting process. The surface oxide layer 4 is typically 0.010 inches thick and must be removed before the blade can be used.

Figure 2:
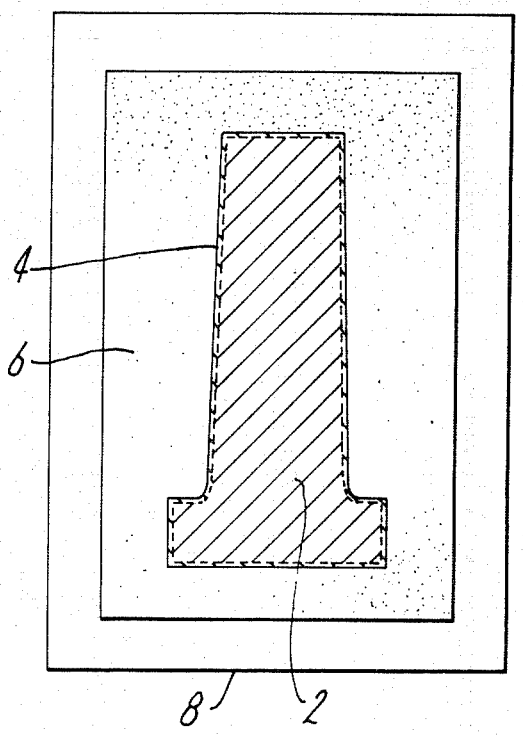

Referring now also to FIG. 2, in order to remove the surface oxide layer 4 from the blade 2, titanium powder 6 is packed around the blade 2 so that the powder is in intimate contact with the surface oxide layer 4. The blade 2 and its titanium powder packing are then vacuum heat-treated by being placed in a vacuum furnace 8 and maintained at a sufficiently high temperature and for a sufficient time to cause the oxygen in the oxide layer 4 of the blade 2 to diffuse out of the blade and into the titanium powder 6 in which the blade is packed, the titanium acting as a scavenge agent to draw the oxygen from the blade 2 and to absorb the oxygen. A small proportion of the oxygen in the layer 4 diffuses into the body of the blade 2 and distributes itself more evenly throughout the body of the blade.

Figure 3:
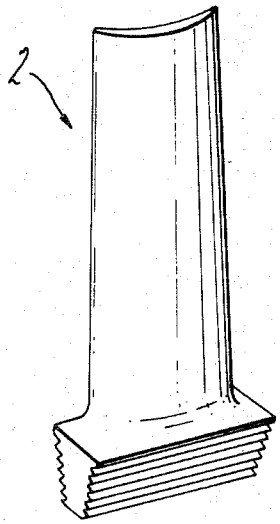

When the vacuum heat-treated blade 2, as shown in FIG. 3, is finally removed from its powder packing, the surface oxide layer 4 which was previously present has completely disappeared and the blade material is of substantially uniform structure throughout. Also, since the surface oxide layer 4 is not bodily removed but is "removed" by converting it back to the material of the blade, no change in blade size occurs and the treated blade retains the fine surface detail and high dimensional accuracy of the blade as cast.

In a modification of the above described method the scavenge agent, i.e. the powder into which the blade is packed for heat treatment, contains also a corrosion resistant substance, e.g. aluminium. In this way, during the heat treatment, while the oxygen in the surface layer is diffusing out of the blade into the titanium in the powder, the aluminium in the powder diffuses into the surface of the blade to give the resultant blade improved corrosion resistance. It will be appreciated that by choosing an appropriate material to diffuse into the blade surface while the oxygen is diffusing out, any desired property can be introduced into the blade.

It will also be appreciated that although in the above described example an oxide layer is removed from an external surface of a blade, the invention is equally applicable to the removal of oxide layers from internal surfaces of blades, e.g. surfaces of internal cooling passages in blades.

It will also be appreciated that although in the above described example titanium powder is used as a scavenge agent, other materials, such as molybdemum, tantalum or niobium, which have an affinity for oxygen may alternatively be used.

The times and temperatures of the process depend on the thickness of the layer, the scavenging agent and the amount of oxygen removal required.

In a typical example, a component having a layer comprising a $\alpha$-case thickness of 0.010 ins. was restored to normal $\alpha/\beta$ phase proportions by heating the component packed in Titanium powder for 64 hours at 950° C. in vacuum.

I claim:

1. A method of treating a surface oxide layer on an article comprising the steps of contacting the surface oxide layer to be treated with a powdered oxygen scavenge agent and heat treating the article in an inert atmosphere for a sufficient time and at a sufficient temperature to cause the oxygen in the surface oxide layer to diffuse into the powdered oxygen scavenge agent so that a substantially unoxidized material of substantially the same dimensions as the surface oxide layer remains as part of the article.

2. A method according to claim 1 wherein the article is a cast titanium component.

3. A method according to claim 2 wherein the oxygen scavenge agent is titanium powder.

4. A method according to claim 1 wherein the powdered oxygen scavenge agent contains an enhancing agent which diffuses into the article during the heat treatment to enhance the properties of the article.

5. A method according to claim 4 wherein the enhancing agent is aluminium.

* * * * *